United States Patent [19]

McKibbin

[11] Patent Number: 4,590,719

[45] Date of Patent: May 27, 1986

[54] ERECTION HINGE

[75] Inventor: John R. McKibbin, Birmingham, Ala.

[73] Assignee: Mason Corporation, Birmingham, Ala.

[21] Appl. No.: 700,603

[22] Filed: Feb. 11, 1985

[51] Int. Cl.[4] ..... B66C 23/06

[52] U.S. Cl. ..... 52/116; 52/120; 52/749; 414/680; 212/179; 212/183

[58] Field of Search ..... 52/116, 120, 127.2, 52/741, 749; 414/680; 212/179, 183, 186

[56] References Cited

U.S. PATENT DOCUMENTS

| | | | |
|---|---|---|---|
| 2,199,897 | 5/1940 | Stringer | 52/116 X |
| 2,403,080 | 7/1946 | Hilborn | 52/116 |
| 2,687,863 | 8/1954 | Vogt et al. | 52/120 X |
| 2,985,261 | 5/1961 | Kubesh | 52/120 |
| 3,015,374 | 1/1962 | Carbert et al. | 52/120 X |

*Primary Examiner*—William F. Pate, III
*Assistant Examiner*—Creighton Smith
*Attorney, Agent, or Firm*—Jennings, Carter, Thompson & Veal

[57] ABSTRACT

An erection hinge for use in erecting columns for open air structures utilizes a mounting plate which removably attaches to the foundation of such structures and which supports an offset hinge. The offset hinge carries a cradle which supports a column to be erected. A gin pole and rigging attached to the cradle or column translates simple linear force into a pivotal motion of the column and cradle on the hinge to position the column on its foundations.

14 Claims, 5 Drawing Figures

ERECTION HINGE

BACKGROUND OF THE INVENTION

The present invention relates to open air structures which utilize relatively short columns to support a cover structure, particularly as may be found providing shelter for gasoline islands at service stations. More particularly the present invention relates to an apparatus and method for use in erecting the columns for such structures. Even more particularly the present invention relates to a reusable hinge mechanism and rigging which allows the erection of such columns without the use of cranes or specialized lifting devices as well as the method for performing such an erection.

Structural covers, such as found at gasoline islands, are familiar objects generally configured with two or more support columns atop which are located I-beams which in turn support longitudinal members that support the roofing. In general the load bearing members, i.e., the support columns and I-beams, are the heaviest and most difficult members to position when erecting the structure. Consequently, heavy machinery, such as cranes or other specialized lifting equipment, is routinely used to position these members during the construction of such covers. Although the use of such machinery greatly facilitates the handling of these structural components, it is not economically feasible to use such machinery, and the cost of such machinery presents a severe economic barrier to small businessmen in the construction business.

SUMMARY OF THE INVENTION

The present invention eliminates the need for heavy machinery in constructing such column supported covers and provides a method and apparatus with which such covers may be constructed using no more specialized machinery than the contractor's pickup truck.

Generally the columns for such cover structures are supported on concrete foundations and are affixed thereto by anchor bolts extending from the foundation. The present invention makes use of these anchor bolts by temporarily attaching a slotted mounting plate thereto. The mounting plate supports a large hinge having a movable arm which is offset from the mounting plate. This movable arm has affixed thereto a cradle which receives the base end of the support column to be positioned. The column is secured in the cradle. With the I-beam already attached to the top of the column, the column is pivoted on the hinge to a vertical position immediately above the anchor bolts through the use of a gin pole and cable attached to whatever motive force is available such as a truck, snatch-block, or winch. The column is then lowered into engagement with the anchor bolts and the mounting plate and hinge is removed.

It is thus an object of the present invention to enable the erection of support columns without specialized heavy equipment.

DESCRIPTION OF THE DRAWINGS

Other advantages and features of the invention will become clearer by reading the description of the preferred embodiment in conjunction with the attached drawings forming a part of this application, wherein.

DESCRIPTION OF A PREFERRED EMBODIMENT

Figure 1:
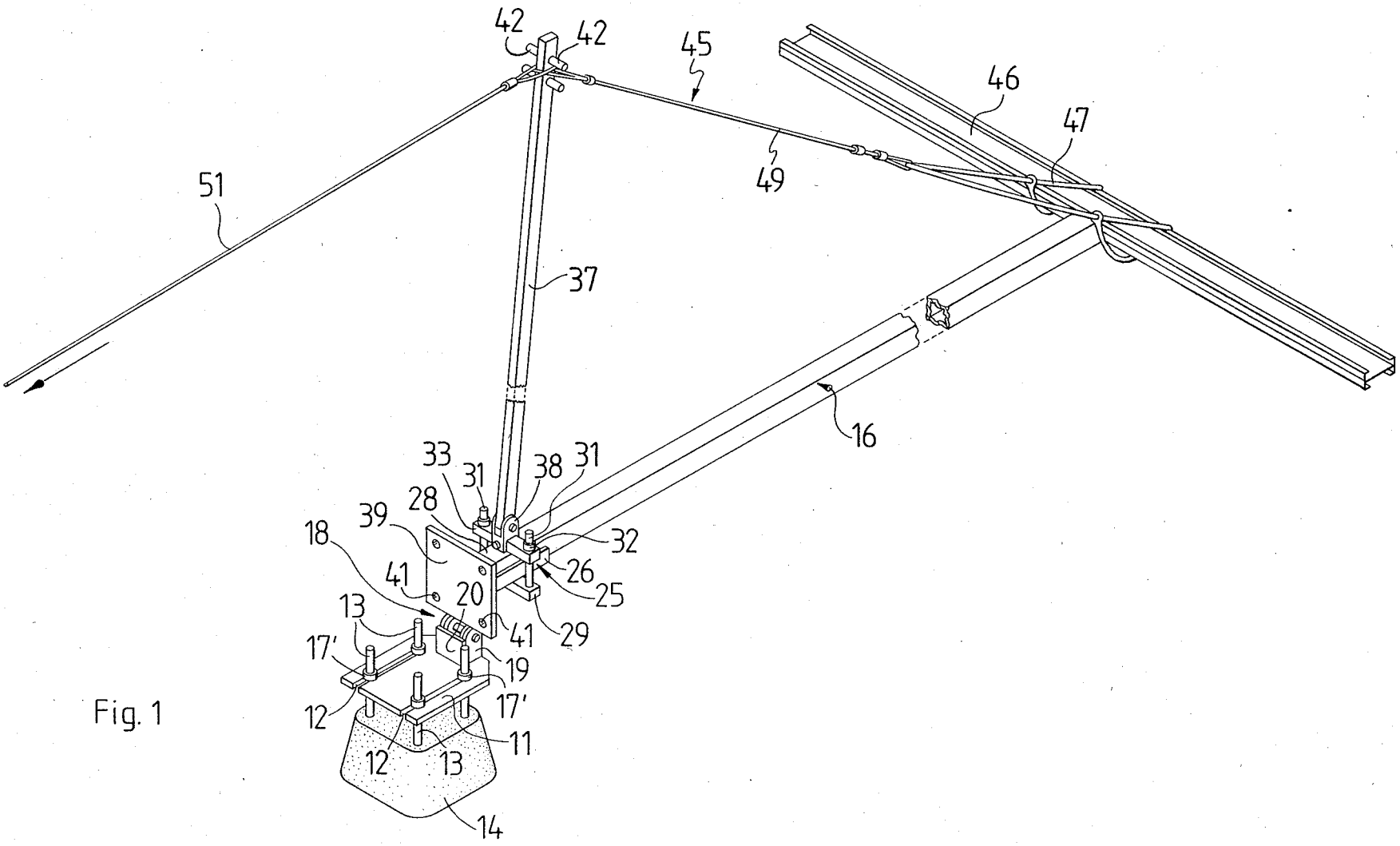
FIG. 1 is a perspective view showing the invention raising a column with an I-beam attached.
Figure 2:
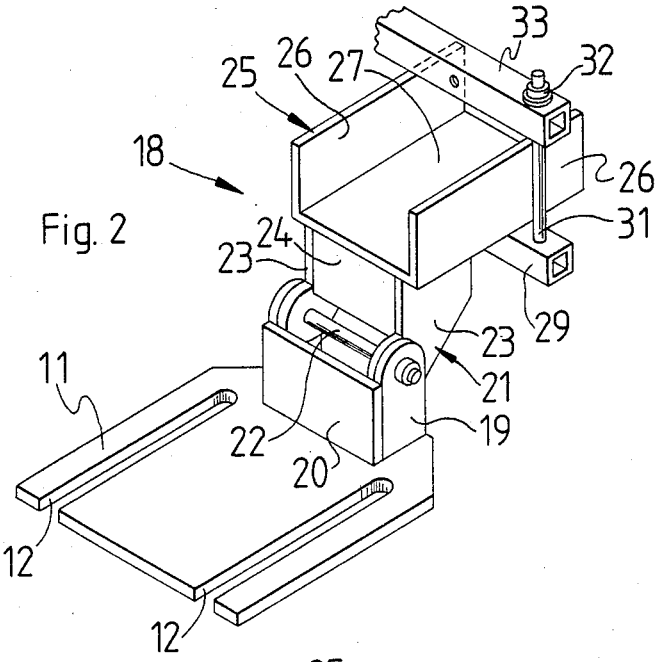
FIG. 2 is a detailed perspective view showing the erection hinge and cradle assembly.

Referring to the drawings, a mounting plate 11 is shown which has a pair of outwardly opening slots 12 therein. The slots 12 allow the mounting plate 11 to slidably engage a set of anchor bolts 13 which extend from a foundation 14. These anchor bolts 13 are used to mount a support column 16 onto the foundation 14 with the threaded portions of the bolts 13 extending above the foundation 14 to receive nuts to fasten column 16 to the bolts. The mounting plate 11 is temporarily secured to each anchor bolt 13 by a pair of internally threaded expendable fasteners or nuts 17 and 17'. The nuts 17 and 17' engage the lower and upper surfaces, respectively, of the mounting plate 11 adjacent the slots 12 to prevent the mounting plate 11 from sliding during the erection of the column 16.

Rigidly attached to the mounting plate 11 near the edge thereof opposite the openings of slots 12 is a hinge assembly indicated generally at 18. This hinge assembly 18 has a pair of upstanding support legs 19 and a movable arm 21 which is pivotally mounted to the legs 19 by a pin 22. The arm 21 comprises two side members 23 and a bridge plate 24 therebetween. The legs 19 and side members 23 have cooperatively aligned apertures through which the pin 22 is inserted. A stop plate 20 is affixed to the legs 19 on the same side thereof as the slots 12 and engages the arm 21 to stop the arm in a horizontal position.

Figure 4B:
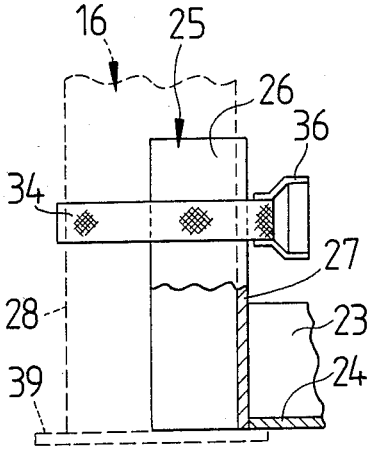

Rigidly affixed to the arm 21 is a rectangularly formed trough-like cradle 25 which has side walls 26 and a cradle plate 27. The cradle 25 is designed to receive the base end portion 28 of the column 16 while the column is resting in a substantially horizontal alignment therewith, as shown in FIG. 1. The width of the cradle plate 27 and the depth of the side walls 26 are design parameters dependent upon the size columns to be erected. Most columns are 10 inch diameter tubular members or 10 inch rectangular members. A single cradle width with appropriate side wall depths would therefore be able to handle either type column. The column 16 must be secured within the cradle 25 by an attachment means which will urge the column 16 against the cradle 25 in a non-sliding manner. A mounting bar 29 of tubular metal is affixed to the outside of cradle plate 27 and extends laterally and outwardly thereof. The mounting bar 29 is apertured adjacent each end to receive connector rods 31 which are threaded to receive cooperatively threaded fasteners 32 on the ends thereof. These connector rods 31 extend through apertures in a retainer bar 33, which may also be formed of tubular metal, which abuts the column 16 on the side thereof opposite the cradle 25. The threaded fasteners 32 on connector rods 31 urge the retainer bar 33 against the column 16 and consequently hold the column 16 in non-sliding engagement with the cradle 25. The retainer bar may have suitable lugs protruding therefrom to more securely engage the column. Alternatively, as shown in FIG. 4*b*, a web strap 34 may be placed around the column 16 and the cradle 25 and tightened sufficiently to secure the column 16. The tightening mechanism 36 may be of a standard variety such as a 10,000 lb. type A rachet snugger.

A gin pole 37 is mounted on the column 16 proximal the hinge assembly 18. This gin pole 37 has a pivotally attached bracket 38 secured to one end thereof which slips over retainer bar 33 to support the gin pole 37. A pin is inserted through the bracket 38 and the retainer bar 33 to connect the two pieces. Alternatively, the bracket 38 can support the gin pole on a base plate 39 which is typically affixed to the bottom of column 16 and which receives the anchor bolts through apertures 41 therein. The pivotal mounting of the gin pole/-bracket 38 allows the gin pole to be set at the desired angle to act as a boom for exerting lifting forces on the column 16.

The gin pole 37 has small protrusions 42 on the upper end thereof which prevents slippage of a flexible non-elastic connector 45 which is looped around the gin pole 37 and engages the protrusions 42. Connector 45 is attached at one end thereof to the column 16 distal the hinge assembly 18. Preferentially an I-beam 46 is affixed to the end of column 16 before erection such that connector 45 may be attached to the I-beam 46, thus eliminating any need for connecting members being attached to the column 16. Connector 45 includes a looped web choker 47 which encircles the I-beam 46 and connects to a length of cable 49 which loops around the gin pole 47, as hereinabove noted. An intermediate cable 51 may extend to a power source, not shown, which may be a bumper of a pickup truck, a power winch, a snatch-block or any other source of motive force.

In operation, the foundation 14 must be prepared with anchor bolts 13 extending therefrom in the conventional manner. A set of bottom nuts 17 are threaded onto bolts 13 to a position slightly displaced from the foundation 14. Mounting plate 11 slidably engages the bolts 13 within its slots 12 and rests atop the bottom nuts 17. Top nuts 17' are threaded onto the bolts 13 and hold mounting plate 11 immobile on bottom nuts 17.

Figure 4A:
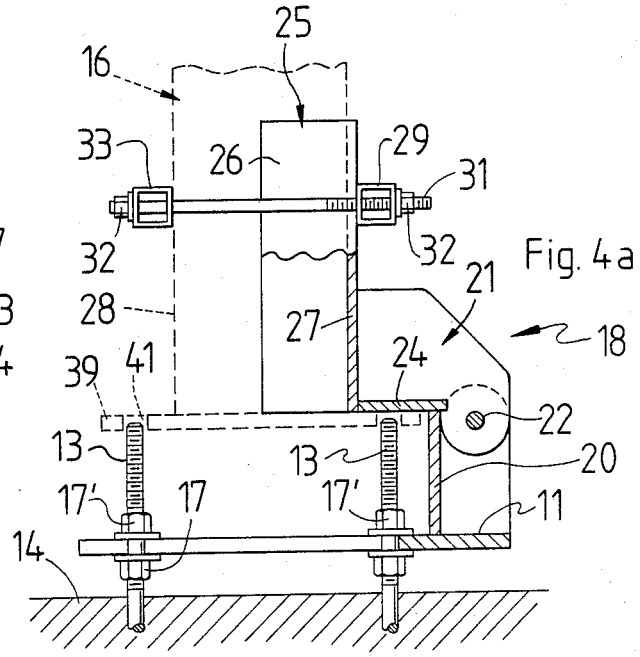
Figure 3:
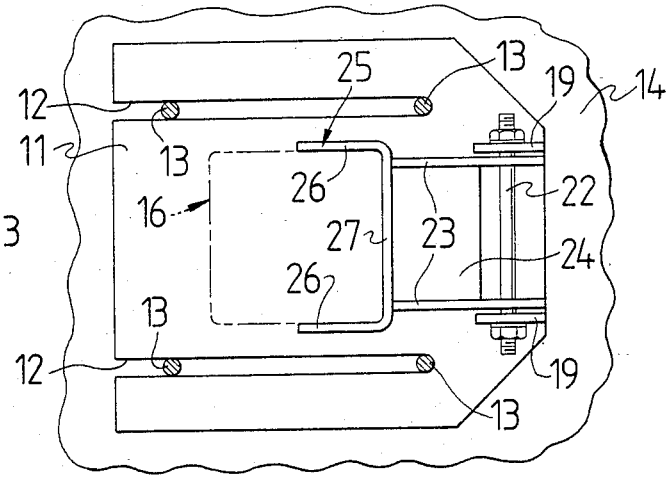
FIG. 3 is a plan view of the erection hinge in position to support a column vertically; and, FIGS. 4*a* and 4*b* are partial sectional views showing the hinge arm positioned to support a column vertically.

The column 16 is positioned within cradle 25 in a horizontal position with the base plate 39 flush against the arm 21 of hinge 18. The attachment means is tightened to secure the column 16 in the cradle 25. Pieces of wood or like material may be used as shims to ensure a snug fit. The I-beam 46 may be attached to the column 16 either before or after securing the column in the cradle 25. The flexible connector 45 is attached to the I-beam 46 and looped around gin pole 37. The bracket 38 is fitted to either retainer bar 33 or to base plate 39 as described above. The gin pole 37 provides a boom to transfer force to the column 16 to move it to a vertical position. The free end of connector 51 is attached to the power source and tensioned, thus positioning the gin pole 37 as shown in FIG. 1. It should be noted that the force applied to the connector 51, the connector 45, the gin pole 37, and the column 16 are all substantially aligned in the same vertical plane which axially bisects the column 16. The column 16 is thus pivoted in this plane about the hinge assembly 18 to a vertical position as shown in FIG. 4*a*. At this position stop plate 20 arrests the rotational motion of the column 16 by engaging the arms 21. In this position the base plate 39 is immediately adjacent the top of the anchor rods 13 which are aligned with the apertures 41. The attaching means is then loosened so that column 16 may descend onto the top nuts 17'. The bottom nuts 17 are loosened and the mounting plate 11 and hinge assembly 18 are withdrawn and the completion of the structure proceeds.

It should be apparent that the utilization of my erection hinge allows the construction of structures using relatively short support columns without the need for expensive heavy equipment such as cranes and the like; therefore my invention provides a great simplification of and enhanced efficiency to the construction process.

While I have shown my invention in several forms, it will be obvious to those skilled in the art that it is not so limited, but is susceptible of various other changes and modifications without departing from the spirit thereof.

What I claim is:

1. An apparatus for erecting a support column for engagement with anchor bolts extending from a foundation, comprising:

(a) engaging means for releasably engaging said anchor bolts proximal said foundation comprising:

(i) a plate-like member having a plurality of outwardly opening slots therein for slidably engaging said anchor bolts; and (ii) expendable fasteners threadably engaging each of said anchor bolts and releasably urged against the upper and lower surface of said plate-like member;

(b) an articulated joint having a fixed member rigidly connected to said engaging means and a movable member vertically offset from said engaging means and pivotally connected to said fixed member along a horizontal axis;

(c) cradle means affixed to said movable member;

(d) attachment means carried by said cradle means for releasably capturing one end of said column within said cradle; and (e) force transfer means for applying force from an external source to the end of said column distal said cradle means for concomitantly pivoting said cradle and column about said horizontal axis.

2. An apparatus for erecting a support column for engagement with anchor bolts extending from a foundation, comprising:

(a) engaging means for releasably engaging said anchor bolts proximal said foundation;

(b) an articulated joint having a fixed member rigidly connected to said engaging means and a movable member vertically offset from said engaging means and pivotally connected to said fixed member along a horizontal axis;

(c) cradle means affixed to said movable member forming a generally channel-like trough to receive one end of said column, said trough extending parallel to said column for a predetermined distance;

(d) attachment means carried by said cradle means for releasably capturing said one end of said column within said cradle; and (e) force transfer means for applying force from an external source to the end of said colunn distal said cradle means for concomitantly pivoting said cradle and column about said horizontal axis.

3. An apparatus for erecting a support column for engagement with anchor bolts extending from a foundation, comprising:

(a) engaging means for releasably engaging said anchor bolts proximal said foundation;

(b) an articulated joint having a fixed member rigidly connected to said engaging means and a movable member vertically offset from said engaging means and pivotally connected to said fixed member along a horizontal axis;

(c) cradle means affixed to said movable member;

(d) attachment means carried by said cradle means for releasably capturing one end of said column within said cradle comprising:

(i) a flexible adjustable belt affixed to said cradle means for encircling said column; and (ii) means for adjusting said belt to urge said column into non-sliding engagement with said cradle; and (e) force transfer means for applying force from an external source to the end of said column distal said cradle means for concomitantly pivoting said cradle and column about said horizontal axis.

4. An apparatus for erecting a support column for engagement with anchor bolts extending from a foundation, comprising:

(a) engaging means for releasably engaging said anchor bolts proximal said foundation;

(b) an articulated joint having a fixed member rigidly connected to said engaging means and a movable member vertically offset from said engaging means and pivotally connected to said fixed member along a horizontal axis;

(c) cradle means affixed to said movable member;

(d) attachment means carried by said cradle means for releasably capturing one end of said column within said cradle comprising:

(i) a retaining bar displaced from said cradle means such that said column is captured therebetween;

(ii) connective rods extending from said cradle means through said retaining bar; and (iii) internally threaded fasteners threadedly engaging said connective rods so as to urge said retaining bar against said column to hold said column in non-sliding engagement with said cradle means; and (e) force transfer means for applying force from an external source to the end of said column distal said cradle means for concomitantly pivoting said cradle and column about said horizontal axis.

5. Apparatus as defined in claim 4 wherein said force transfer means comprises:

(a) a gin pole detachably affixed at one end thereof to said column proximal said articulated joint;

(b) a non-elastic flexible member attached to said column distal said cradle means and to said gin pole distal said column; and (c) connecting means attached to said external source and to said gin pole distal said column, said gin pole, said non-elastic member, and said connecting means all aligned substantially within the same vertical plane.

6. Apparatus as defined in claim 4 wherein said gin pole is detachably affixed to said column by said retaining bar.

7. An apparatus for erecting a support column for engagement with anchor bolts extending from a foundation, comprising:

(a) engaging means for releasably engaging said anchor bolts proximal said foundation;

(b) an articulated joint having a fixed member rigidly connected to said engaging means and a movable member vertically offset from said engaging means and pivotally connected to said fixed member along a horizontal axis;

(c) cradle means affixed to said movable member;

(d) attachment means carried by said cradle means for releasably capturing one end of said column within said cradle; and (e) force transfer means for applying force from an external source to the end of said column distal said cradle means for concomitantly pivoting said cradle and column about said horizontal axis comprising:

(i) a gin pole detachably affixed at one end thereof to said column proximal said articulated joint;

(ii) a non-elastic flexible member attached to said column distal said cradle means and to said gin pole distal said column; and (iii) connecting means attached to said external source and to said gin pole distal said column, said gin pole, said non-elastic member, and said connecting means all aligned substantially within the same vertical plane.

8. Apparatus for erecting support columns which engage anchor bolts extending from a foundation comprising:

(a) a mounting plate detachably attached to said anchor bolts with said mounting plate having outwardly opening slots therein for slidably engaging said anchor bolts, said mounting plate being attached to said anchor bolts by expendable fasteners threadably engaged on said anchor bolts;

(b) a hinge having a fixed member and a movable member, said fixed member rigidly attached to said mounting plate;

(c) a cradle carried by said movable member for receiving one end of said column;

(d) attachment means for securing said column within said cradle; and (e) means for transferring an erecting force to said column distal said hinge such that said cradle and column are concomitantly pivoted on said hinge.

9. Apparatus for erecting support columns which engage anchor bolts extending from a foundation comprising:

(a) a mounting plate detachably attached to said anchor bolts;

(b) a hinge having a fixed member and a movable member, said fixed member rigidly attached to said mounting plate;

(c) a cradle carried by said movable member for receiving one end of said column;

(d) attachment means for securing said column within said cradle comprising a flexible strap, adjustably secured to said cradle so as to retain said column within said cradle; and (e) means for transferring an erecting force to said column distal said hinge such that said cradle and column are concomitantly pivoted on said hinge.

10. Apparatus for erecting support columns which engage anchor bolts extending from a foundation comprising:

(a) a mounting plate detachably attached to said anchor bolts;

(b) a hinge having a fixed member and a movable member, said fixed member rigidly attached to said mounting plate;

(c) a cradle carried by said movable member for receiving one end of said column;

(d) attachment means for securing said column within said cradle comprising:

(i) a retaining bar abutting said column opposite said cradle; and (ii) connector rods connected between said retaining bar and said cradle for urging said retaining bar against said column to hold said column within said cradle; and (e) force transfer means for transferring an erecting force to said column distal said hinge such that said cradle and column are concomitantly pivoted on said hinge.

11. Apparatus as defined in claim 10 wherein said force transfer means comprises:

(a) a gin pole detachably carried by said retaining bar;

(b) a flexible non-elastic connector detachably affixed at one end to said column distal said hinge and affixed at a predetermined length to said gin pole distal said retaining bar; and (c) a second non-elastic connector for connection between said gin pole and a source of motive force.

12. Apparatus for erecting support columns which engage anchor bolts extending from a foundation comprising:

(a) a mounting plate detachably connected to said anchor bolts;

(b) a hinge having a fixed member and a movable member, said fixed member rigidly attached to said mounting plate;

(c) a cradle carried by said movable member for receiving one end of said column;

(d) attachment means for securing said column within said cradle; and (e) means for transferring an erecting force to said column distal said hinge such that said cradle and column are concomitantly pivoted on said hinge comprising:

(i) a boom connected to said hinge; and (ii) non-elastic connector means detachably affixed to said column distal said hinge and connected to said boom distal said hinge and having a free end for connecting to a source of motive force, said boom, said connector, and said column all substantially aligned in the same vertical plane.

13. The method of erecting a column from a horizontal position to a vertical position comprising the steps of:

(a) forming a foundation having anchor bolts extending therefrom;

(b) detachably affixing an offset hinge to said anchor bolts;

(c) detachably securing one end of said column to said offset hinge while said column is in a substantially horizontal position;

(d) pivoting said column on said hinge to a vertical position above said anchor bolts;

(e) releasing said column from said hinge into engagement with said anchor bolts;

(f) detaching and removing said hinge from said anchor bolts.

14. The method of claim 13 wherein said pivoting step comprises:

(a) attaching a boom to said column proximal said hinge;

(b) securing said boom in spaced angular relation to said column; and (c) applying a lateral force to said boom distal said hinge, with said force, said column, and said boom being substantially aligned in the vertical plane axially bisecting said column.

* * * * *